United States Patent [19]

Brandl et al.

[11] 3,982,347

[45] Sept. 28, 1976

[54] TRIGGER MECHANISM FOR ELECTRICALLY IGNITED WEAPONS

[75] Inventors: Rudolf Brandl, Weiden; Tilo Möller; Karl Saile, both of Oberndorf; Heinrich Streckfuss, Dettingen, all of Germany

[73] Assignee: Heckler & Koch GmbH, Oberndorf, Germany

[22] Filed: Feb. 7, 1975

[21] Appl. No.: 548,151

[30] Foreign Application Priority Data

Feb. 14, 1974 Germany ..... 2406933

[52] U.S. Cl. ..... 42/84; 42/70 E; 89/28 R

[51] Int. Cl.[2] ..... F41C 19/12

[58] Field of Search ..... 42/84, 70 E, 71 P; 89/28 R, 28 C, 135

[56] References Cited

UNITED STATES PATENTS

| | | | |
|---|---|---|---|
| 3,208,181 | 9/1965 | Calhoun et al. | 42/84 |
| 3,859,746 | 1/1975 | Pecksen | 42/84 |

*Primary Examiner*—Charles T. Jordan
*Attorney, Agent, or Firm*—Spencer & Kaye

[57] ABSTRACT

A trigger mechanism for electrically ignited weapons having a source of electric energy. Leads are provided which connect the source of energy with the electrical ignition means for a propelling charge contained in the weapon, and a normally open switch is interposed in one of said leads, which switch can be closed for igniting the ignition means by pulling the trigger. The source of energy comprises a piezoelectric body and a capacitor connected in parallel with the piezoelectric body, the trigger being coupled with a striker which is tripped from a tensioned position when the trigger is pulled and released for striking the piezoelectric body before the switch closes. The leads are connected with the capacitor and a diode is arranged between the piezoelectric body and the capacitor, the polarity thereof being such that the charge produced as a result of the blow of the striker against the piezoelectric body flows into the capacitor but cannot flow back from the capacitor to the piezoelectric body and the electrical energy stored in the capacitor is available for igniting the ignition means when the switch subsequently closes.

19 Claims, 5 Drawing Figures

TRIGGER MECHANISM FOR ELECTRICALLY IGNITED WEAPONS

The present invention relates to a trigger mechanism for electrically ignited weapons having a source of electric energy, leads connecting the source of energy with the electrical ignition means for a propelling charge contained in the weapon, and a normally open switch which is interposed in one of the leads and which can be closed for igniting the ignition means by pulling the trigger.

In known trigger mechanisms of this type, a battery is employed as the source of electrical energy. The employment of batteries brings with it the disadvantage that they lose power over the course of time, even if not used, so that it is consequently not possible to store weapons equipped with trigger mechanisms of this type in an operational condition for extended periods of time. On the contrary, weapons having trigger mechanisms of this type must be prepared before use through the insertion of batteries. Constant supervision and special storage of the batteries are necessary in particular in the case of weapons which are employed only once, as is particularly the case with anti-tank weapons, and which may possibly be returned again when they are not used during the mission. The employment of an electrical ignition system is therefore problematical with weapons of this type, although an electrical ignition system would be advantageous especially for weapons of this type, as the ignition means of the propelling charge and the trigger mechanism can be located at a great distance one from the other and can be unfavourably associated one to the other, with the result that the employment of mechanical trigger mechanisms also entails significant problems.

The employment of electrical mechanisms for igniting the charges of granades and rockets is known. These ignition mechanisms contain electromagnetic or piezoelectric pulse generators as the energy source. The impact energy of grandades an rockets against the target is of sufficient magnitude to permit sufficiently large charges to readily be produced for generating the current required for igniting ignition means with the employment of piezoelectric bodies as the source of energy. On the other hand, the forces which can be achieved by means of a manually operated trigger mechanism are relatively small and the manually produced forces are not readily sufficient for ensuring the ignition of electrical ignition means. Mechanisms of the type which are known for igniting cigarette lighters for example, in which a spark of low energy is produced by a blow to a piezoelectric body, for which a very high voltage but only a small charge is required, are therefore not suitable as the trigger mechanism for electrically ignited weapons. On the contrary, it is the object of the present invention to create a trigger mechanism for electrically ignited weapons of the type described above which does not require batteries as the source of energy and which therefore can be stored for any desired length of time without special maintenance and supervision. Nevertheless, the trigger mechanism should be of simple design and characterized by a high degree of dependability.

According to the present invention, this object is solved in that the source of energy comprises a piezoelectric body and a capacitor connected in parallel with the piezoelectric body, in that the trigger is coupled with a striker which is tripped from a tensioned position when the trigger is pulled and released for striking the piezoelectric body before the switch closes, and in that the leads are connected with the capacitor and a diode is arranged between the piezoelectric body and the capacitor, the polarity thereof being such that the charge produced as a result of the blow of the striker against the piezoelectric body flows into the capacitor but cannot flow back from the capacitor to the piezoelectric body and the electrical energy stored in the capacitor is available for igniting the ignition means when the switch subsequently closes.

The invention thus utilizes a piezoelectric body as the source of energy, although no large impact energies are available in trigger mechanisms and the energy supplied by the piezoelectric body in the form of a relatively high voltage and low charge is not capable of supplying the ignition current for ignition means. However it has been found that a piezoelectric body is also quite suitable as the source of energy for manually operated trigger mechanisms if the charge produced on the piezoelectric material is first recharged on a capacitor before being advanced to the ignition means. A piezoelectric body has a very low capacity, with the result that the charge produced has a very high voltage. Accordingly, when a small resistance is applied to the piezoelectric body a high current flows, causing the available charge to be consumed very quickly. The duration of the flow of current is then too short for igniting relatively slow acting ignition means. However if the charge is first recharged on a capacitor of relatively high capacity, there is a relatively low voltage at this capacitor, and when a low resistance is applied only a relatively low current flows, which continues howver for a longer period of time. The capacitor can then be dimensioned in such a manner that the current thereby attained as well as the duration of the flow of current are sufficient for ensuring dependable ignition of the ignition means. This result could not readily be foreseen.

A very simple design of a trigger mechanism of this type results if the striker is retained in the tensioned position by an engagement member and a striker spring is arranged between trigger and striker, the striker spring being tensioned by pulling the trigger before the trigger engages the engagement member for releasing the striker. In a preferred embodiment of the invention, the trigger is designed as a slide and, in its direction of travel, the striker spring, the striker and the piezoelectric body are arranged one behind the other and the striker is in a supporting relationship with the trigger by means of the striker spring.

Aside from its simple mechanical design, an arrangement of this type offers the advantage that only by pulling the trigger is the striker spring tensioned enough for it to be able to strike the striker against the piezoelectric body with the energy required for igniting the ignition means, so that ignition of the ignition means is not possible as a result of an undesired release of the striker without pulling the trigger. Moreover, the engagement member retaining the striker in the tensioned position is not tensioned if the trigger is not pulled.

The striker can be guided in a tube, for example, whose open end engages a tubular extension of the trigger, with the piezoelectric body being arranged on its other end. In this connection, a return spring for the trigger can then also be arranged between the end of the tube and the base of the tubular extension. In an especially preferred embodiment of the invention, the striker has a head, facing the piezoelectric body, and a shank, on which the striker spring, designed as a coil compression spring, is arranged, with that end thereof facing away from the head engaging a hole, with a step-shaped configuration, in a portion of the trigger and having a collar which is in a supporting relationship with a shoulder of the step-shaped hole under the force of the striker spring when the trigger is not pulled. In this embodiment of the invention, the distance which the head of the striker can assume relative to the trigger is limited by the length of the shank, whose collar is in a contacting relationship with a shoulder of the trigger. In this connection, the striker spring, in a supporting relationship with the trigger on the one hand and with the head of the striker on the other, can be pretensioned to a certain degree. This permits simpler setting of a defined magnitude of energy, with which the striker strikes the piezoelectric body. Nevertheless, the arrangement can be designed in such a manner that the striker is retained at a distance from the engagement member in the position of rest of the trigger, i.e. that the engagement member is not subject to any tension as long as the trigger remains in the position of rest. That portion of the trigger containing the step-shaped hole can be formed by a sleeve inserted into the tubular extension, with the return spring also being supported against this sleeve in addition to the striker spring.

In the above described embodiment of the invention, the engagement member can, in a simple manner, be formed by a spring-loaded pawl arranged on the outside of the tube, the nose of the pawl penetrating into an aperture in the wall of the tube, with the free end of the pawl, facing the tubular extension of the trigger, having an inclined plane with which a corresponding inclined plane on the tubular extension engages when the trigger is pulled in order to deflect the engagement member.

In order to achieve a high degree of efficiency of the trigger mechanism according to the invention, it is important for the striker to strike the piezoelectric body firmly and not to rebound in order for the kinetic energy of the striker to be transmitted as completely as possible to the piezoelectric body and utilized for producing the desired charge, insofar as a voltage doubling circuit is not employed, which would permit the opposite charge formed at the piezoelectric body as a result of its relief to be utilized. A voltage doubling circuit of this type has two capacitors, connected both in series and individually parallel with the piezoelectric body by means of diodes in such a manner that either the one or the other of the two capacitors is charged, depending upon the polarity of the charge produced.

If rebounding of the striker from the piezoelectric body is to be avoided, the striker can be equipped with a secondary striking mass. This secondary striking mass can be a spring-loaded member. However the employment of a granulate arranged in a cavity in the striker is preferred. If the trigger mechanism is intended for weapons which are only to be used once, any material with a sufficiently high specific gravity can be employed as the granulate. However a heavy-metal granulate, in particular tungsten granulate, is generally preferred.

The switch providing the connection between the capacitor and the ignition means after the capacitor has been charged can have a mechincal switching member, in particular a contact tongue, with which the trigger engages after having exceeded that position which is required for releasing the striking member. Since the shooter will always pull the trigger all the way, insofar as the shot is not fired beforehand, a simple arrangement of this type is sufficient for ensuring that the switch is not closed until the striking member has been released and has struck the piezoelectric body, so that a charge has been produced on the piezoelectric body and transmitted to the capacitor. The employment of a mechanical switch is very simple and does not necessitate any great expense. Moreover, a mechanical switch can be designed as a changeover switch in a very simple manner, which short circuits those leads leading to the ignition means in its position of rest. A short circuit of this type effectively prevents voltage from forming in these leads and current from flowing through the ignition means, which would result in undesired ignition of the ignition means. A switch of this type thus offers increased safety.

However instead of the mechanical switch, it is also possible to employ an electronic switch, which closes upon attainment of a preselected voltage at the capacitor. The employment of an electronic switch of this type instead of a mechanical switch again offers the advantage that no mechanically moving parts are required. A measure of this type can be of significance if the weapon is intended for use in situations in which it is subjected to great vibration or if only very little space is available for the trigger mechanism, as electronic switches generally require less space than mechanical switches. Thus, for example, the electronic switch can be a controllable rectifier whose ignition electrode is connected to a preferably capacitative voltage divider connected in parallel with the capacitor. However it is also possible to simply employ a diode operated in the blocking direction as an electronic switch, whereby the diode breaks down upon attainment of the preselected voltage, thereby forming a short circuit. Instead of a conventional diode, a four-layer diode can also be employed. If employed instead of a controllable rectifier, it offers the advantage that it can be directly voltage controlled, i.e. it does not require any special drive. As opposed to conventional diodes operated in the blocking direction, it offers the advantage that its forward breakover voltage can be stipulated within narrow tolerances.

In a further development of the invention, the piezoelectric body can be connected directly in parallel with a diode which, viewed in series with the diode connecting the piezoelectric body with the capacitor, has the same polarity as the diode. This diode, connected in parallel with the piezoelectric body, does not prevent charges resulting from a blow to the piezoelectric body from being transmitted to the capacitor, however does short circuit any opposite charges which could result through the influence of any mechanical tension on the piezoelectric body. This measure ensures that no charges can be stored on the piezoelectric body whose polarity is opposite to the polarity of the charge which is produced by a blow to the piezoelectric body, thereby preventing the charge produced by the blow from being compensated for by the opposite charges, and further ensuring that the charge produced by the blow is always fully available. Accordingly, this diode also provides additional safety.

The piezoelectric body can be arranged together with a transmission body in a simple manner in an insulating housing, with the transmission body extending therefrom on the side facing the striker. This ensures simple, dependable retention of the piezoelectric body and proper transmission of the force from the striker to the piezoelectric body.

Although the above described embodiment of the trigger mechanism according to the present invention in themselves already ensure that undesired ignition of the ignition means is not possible, in a preferred embodiment of the trigger mechanism according to the present invention, a swivel member, which is retained by a spring in its position of rest and whose centre of gravity is staggered perpendicular to the direction of travel of the trigger relative to the swivel axis of the swivel member, is arranged in the path of the trigger in such a manner that in the event of a blow acting in the sense of actuation of the trigger the swivel member performs a swivel motion against the force of the spring, thereby blocking the trigger. This thereby eliminates every possibility for tripping the trigger mechanism according to the present invention as a result of a blow causing the trigger to be actuated, no matter how great this blow may be. A particular advantage of this type of safety is the fact that it can also be employed as a permanent safety for the trigger mechanism. A grip can be pivoted to the trigger mechanism housing for this purpose, the grip being capable of being swivelled into a position of rest, in which it covers the trigger and in which a projection presses the swivel member out of its position of rest and into the locked position.

The above discussed and other objects, features, advantages and embodiments of the present invention will become more apparent from the following description thereof, when taken in connection with the practical examples shown in the accompanying drawings. The features contained in the description and the drawings may be employed in other embodiments individually or in any desired combination.

Figure 1:
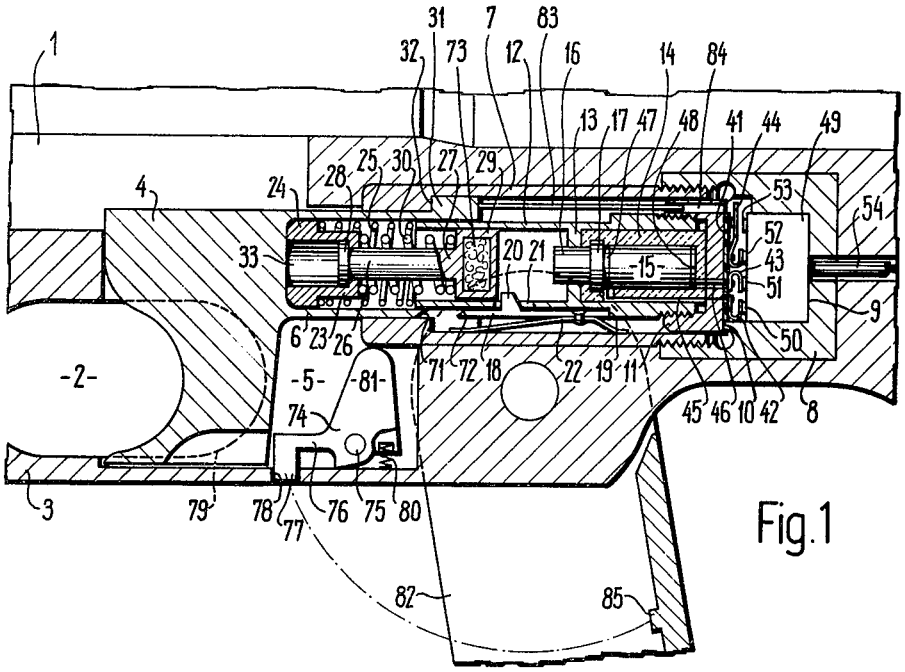
FIG. 1 shows a longitudinal section through a trigger mechanism according to the invention, with the trigger in the position of rest.
Figure 2:
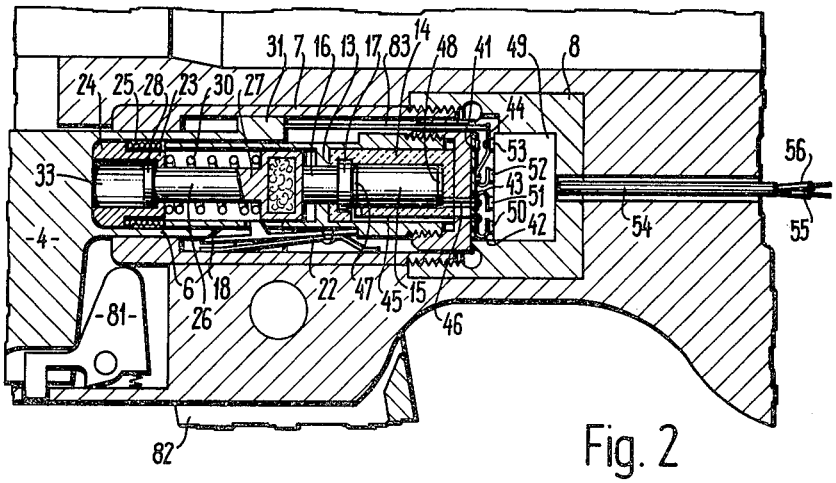
FIG. 2 shows a longitudinal section through the trigger mechanism according to FIG. 1, with the trigger pulled.

Referring now to the drawings, wherein like reference numerals designate like parts throughout the several views, the trigger mechanism illustrated in FIGS. 1 and 2 is arranged in a grip assembly 1 of metal or plastic, which is intended to be attached to weapons in a manner not illustrated in more detail. This grip assembly 1 has an aperture 2 for the formation of a trigger guard 3, as well as recesses for receiving the members comprising the trigger mechanism. The trigger mechanism comprises a trigger 4, which is designed as a slide and guided in a slot-shaped recess 5 in grip assembly 1. The rear of trigger 4, based on the direction of fire, has a tubular extension 6, with which it is guided in a tubular housing 7 arranged in grip assembly 1. The rear of the tubular housing is closed by means of a screw cap 8, having a shoulder 10 at a distance from its base 9, with the lid 11 of a tube 12, inserted in tubular housing 7 and arranged concentrically thereto, being in a supporting relationship with shoulder 10. The front, open end of tube 12 extends into tubular extension 6 of trigger 4.

Arranged within tube 12 is a cross wall 13 having a central hole. Tensioned between cross wall 13 and lid 11 is an insulating housing 14, containing a piezoelectric body 15 with a transmission body 16 being connected to the front thereof. Transmission body 16 is in a supporting relationship with a shoulder in the interior of the housing by means of a collar 17, and extends through the hole in cross wall 13. In addition, a longitudinally extending pawl 18 is also arranged on the outside of tube 12, with the rear end of pawl 18 being in a supporting relationship with a shoulder 19 on the outside of tube 12 and a nose 20 of pawl 18 penetrating through an aperture 21 in the wall of the tube. Attached to the outside of pawl 18 is a leaf spring 22, extending parallel to pawl 18; both ends of leaf spring 22 are in supporting relationships with the interior of tubular housing 7.

Arranged within tubular extension 6 of trigger 4 is a sleeve 23, which is in a supporting relationship with the base of tubular extension 6 and whose rear end has an outwardly extending collar 24, which serves as a support for return spring 25, which is guided by tubular extension 6 and whose other end is in a supporting relationship with the end of tube 12, extending into the tubular extension. The hole 33 in sleeve 23 has a step-like configuration, with its rear end having a section of reduced diameter. The sleeve is engaged by the shank 26 of a striker 27, whereby the end located within sleeve 23 has a collar 28 and its other end has a head 29. Arranged on shank 66 between sleeve 23 and head 29 is a striker spring 30, which is pretensioned to a certain degree, thereby holding collar 28 of the striker in a contacting relationship with the shoulder of sleeve 23. In the position of rest shown in FIG. 1, in which return spring 25 holds a collar 31 of trigger 4 in a contacting relationship with a shoulder 32 on the front end of tubular housing 7 and the rear of lid 11 of tube 12 in a contacting relationship with shoulder 10 of screw cap 8, the end surface of head 29 of striker 27 is located a slight distance in front of nose 20 of pawl 18.

Attached to the outside of lid 11 is an insulating plate 41, on which two contacts 42 and 43, as well as a contact spring 44, are located. The two contacts 422 and 43 are connected in an electrically conductive manner with electrodes 47 and 48, which are arranged on the end surfaces of piezoelectric body 15, by means of insulated leads 45 and 46. In its position of rest, contact spring 44 is located on a section of insulating plate 41 which has a conductive coating which is connected in an electrically conductive manner with lower contact 42. Located in the cavity between the base of screw cap 8 and lid 11 of the tube is an artifical-resin block 49, in which the electrical switching means are potted, whereby that end of block 49 facing insulating plate 41 has four contact surfaces 50 to 53, of which the first two are connected with contacts 42 and 43 and the third is connected with a bent end of contact tongue 44. The last contact surface 53 faces that end of contact spring 44 which is normally in a contacting relationship with insulating plate 41 at a distance therefrom. Extending from the rear end surface of artificial-resin block 49 is a cable 54 having two leads 55 and 56, which are run to an unillustrated mechanism of the weapon to which the trigger mechanism is attached, on which an electrical connection can be made to the ignition means for the propelling charge of the bullet located in the weapon.

Figure 3:
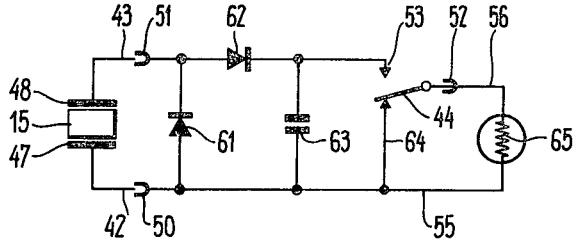
FIG. 3 shows the circuit diagram of the trigger mechanism according to FIGS. 1 and 2.

As can be seen from the circuit diagram shown in FIG. 3, artificial-resin block 49 has two diodes 61 and 62, as well as a capacitor 63. The first diode 61 is connected directly in parallel with piezoelectric body 15, having electrodes 47 and 48, by means of contacts 42, 50 and 43, 51. Arranged in parallel with the first diode 61 is a series connection comprising the second diode 62 and capacitor 63. Attached at the point of connection between second diode 62 and capacitor 63 is contact surface 53 of artificial-resin block 49, which acts conjointly with spring tongue 44 of the switch. As already mentioned above, second contact 64 of the switch is connected with contact surface 50. Of the two leads 55 and 56 extending from artificial-resin block 49, one is again connected with a contact surface 50 and the other with spring tongue 44 by means of contact surface 52. As already mentioned, leads 55 and 56 are run to electrical ignition means, which preferably have an ignition gap 65.

With the trigger mechanism according to the invention, to fire a shot trigger 4 is pulled in the usual manner; i.e. in the arrangement shown in the drawing, it is pulled to the right from the position indicated in FIG. 1 into the position illustrated in FIG. 2, while simultaneously tensioning return spring 25. During this sequence, striker 27 is first driven by striker spring 30 until its head 29 comes into a contacting relationship with nose 20 of pawl 18, which extends into tube 12. When the trigger is pulled further, striker spring 30 is then also tensioned, in addition to return spring 25. This sequence continues until an inclined plane 71, attached to tubular extension 6 of trigger 4 in an indentation in collar 31 comes into a contacting relationship with a corresponding inclined plane 72 on the front end of pawl 18 and, when pulled further, deflects the pawl, causing nose 20 to be withdrawn from the end surface of head 29 of striker 27. This releases the striker, which is now accelerated by striker spring 30, which now is relieved, and strikes transmission body 16 arranged in front of piezoelectric body 15. In order to ensure the most complete possible transmission of the kenitic energy of striker 27 against piezoelectric body 15, a secondary striking mass in the form of a tungsten granule is arranged in a cavity in head 29 of the striker. The blow against piezoelectric body 15 results in charges on its end surfaces. The orientation of the piezoelectric body and the poles of the diodes are selected in such a manner that the charges formed on piezoelectric body 15 as a result of the blow to this body can flow to capacitor 63 via second diode 62. This capacitor has a significantly higher capacity than the piezoelectric body, so that capacitor 63 can accept a considerably higher charge, without the voltage at the capacitor having to assume excessively high values.

Before striker 27 is released, the trigger is pulled against the force of striker spring 30. After the striker is released, there is a sudden relief, which ensures that trigger 4 is pulled beyond that position in which the striker is releated. As the trigger is pulled further until a rear stop, a shifter rod 83, which is attached to tubular extension 6 of trigger 4 in collar 31 and whose free end is guided in a hole 84 in lid 11 of tube 12, comes into engagement with spring tongue 44, lifts the spring tongue away from the conductive surface on insulating plate 41 and places it against conductive surface 53 of insulating block 49. As can be seen from the circuit diagram according to FIG. 3, this produces a conductive connection between capacitor 63 and ignition gap 65 of the ignition means, permitting the charge stored in capacitor 63 to now flow over ignition gap 65. This heats up the igntion gap and ignites the ignition means. The transmission of the charge from piezoelectric body 15 to capacitor 63, having a higher capacity, ensures that the time constant determining the discharge sequence, which is proportional to the product of the capacity C of capacitor 63 and the resistance R of the ignition gap, is increased in such a manner that the time is sufficient for heating the ignition gap to the temperature required for igniting the ignition means.

The poles of the first diode 61 are arranged in such a manner that when first diode 61 is viewed in series with second diode 62 it has the same conducting direction as the second diode. This arrangement encures that charges formed on piezoelectric body 15, whose polarity is opposite to those charges produced by a blow, are short circuited and can therefore not compensate for charges produced by a blow. This ensures that all the charges produced by the blow to the piezoelectric body resulting from the trigger being pulled are available for igniting the ignition means. The switch formed by spring tongue 44 normally short circuits the ignition means, thereby preventing any undesired ignition of the ignition means as a result of any charges or other effects there also. First diode 61 and spring tongue 44 thus play a significant role in the dependability of the illustrated practical example of the trigger mechanism.

A further safety factor in the illustrated practical example is the fact that in the position of rest of the trigger the striker is not yet tensioned, and pawl 18 can therefore be moved from its engaged position without causing an undesired shot to be fired. A further signficant safety feature is the fact that the trigger must be pulled against the striker spring, so that a relatively large amount of force is required in order to move the trigger unintentionally from its position of rest, and a shot can only be fired if the trigger is really pulled all the way to its rearmost position. In actual practice, this would hardly be possible. However in order to avoid the possibility of accidents resulting while the loaded weapon is transported as a result of heavy blows in the direction of the trigger pull, in the illustrated practical example a swivel member 74 is mounted on a pin 75 behind trigger 4 in grip assembly 1; pin 75 extends crosswise through grip assembly 1. Swivel member 74 has an arm 76, which extends parallel to the direction of travel of trigger 4 and which extends to a point very close to the rear of trigger 4 and whose nose 77 projects into an opening 78 in the bottom of grip assembly 1. The bottom edge of trigger 4 has a slot-shaped recess 79, which receives arm 76 of swivel member 74 when trigger 4 is moved to the rear in the position of rest of swivel member 74 illustrated in FIG. 1. In this position of rest, the swivel member is retained by means of a spring 80, which is arranged between a section of the wall of grip assembly 1 and swivel member 74 on that side of pin 75 which is opposite arm 76.

Swivel member 74 has a flywheel mass 81 which extends into a cavity in grip assembly 1 at right angles to arm 76 in such a manner that the centre of gravity of swivel member 74 is shifted perpendicular to the direction of travel of the trigger relative to the axis of rotation of swivel member 74. This ensures that in the event of a blow in the direction of travel of the trigger, swivel member 74 performs a swivel motion in the clockwise direction against the force of spring 80, causing the free end of arm 76 to egress from the area of recess 79 in trigger 4 and block the rear of the trigger. This further increases the safety of the illustrated trigger mechanism. In the illustrated practical example, swivel member 74 is also utilized as a permanent safety. For this purpose, swivel member 74 operates conjointly with a grip 82, which is pivoted to grip assembly 1 and which can be swivelled out of the operational position shown in FIG. 1 into a position of rest, in which it covers aperture 2 in the grip assembly with trigger 4. In this position of rest, a projection 85 comes into a contacting relationship with nose 77 of swivel member 74 on the inside of the U-shaped cross section of the grip and swivels swivel member 74 in a clockwise direction, causing it to block the trigger with the end of its arm 76 here also.

Figure 4:
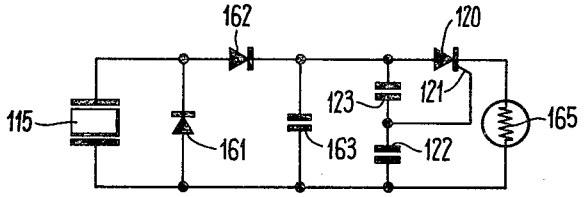
FIGS. 4 and 5 show circuit diagrams of other trigger mechanisms.

The mechanical switch serving to connect capacitor 63 and ignition gap 65 of the ignition means in the practical example shown in FIGS. 1 to 3 can also be replaced by means of electronic switches. Simple arrangements herefor are shown by the circuit diagrams in FIGS. 4 and 5. In the embodiment according to FIG. 4, a piezoelectric body 115 is again connected in parallel with a first diode 161 and, in addition, with the series connection of a second diode 162 and a capacitor 163. Insofar, the arrangement shown in FIG. 4 is the same as that shown in FIG. 3, and the method of operation is also the same. However in this case the switch is not mechanical, but in the form of a controllable rectifier 120, for example a thyristor, or, instead of this, a four-layer diode. This rectifier is non-conducting until a voltage of suitable magnitude is applied to its ignition electrode. In the illustrated pratical example, this voltage is produced by a capacitive voltage divider, comprising two series-connected capacitors 122 and 123, connected in parallel with capacitor 163. If capacitors 122 and 123 are appropriately dimensioned, they can also replace capacitor 163. When the voltage at capacitor 163 or at the voltage divider formed by capacitors 122 and 123 reaches a preselected value as a result of being charged by the voltage supplied from piezoelectric body 115, the voltage tapped from between the two capacitors of the voltage divider and applied to ignition electrode 121 of controlled rectifier 120 is sufficient to make the controlled rectifier conductive. The charge can then flow over ignition gap 165 of the ignition means from capacitors 163, 122 and 123, causing the ignition means to ignite. This arrangement provides the advantage that mechanical switching means are not required, however on the other hand ignition gap 165 is not secured by means of a short circuit. If a four-layer diode is employed instead of thyristor 120, capacitors 122 and 123 are not required.

If the voltage at capacitor 163 reaches the breakdown voltage of the four-layer diode, it arcs through, and current flows on capacitor 163 to ignition gap 165.

Figure 5:
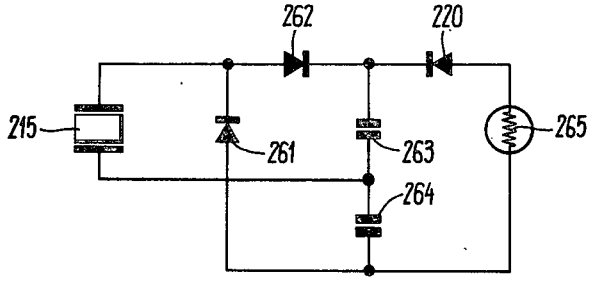

If the trigger mechanism according to the invention is to be employed for weapons which are only fired once, so that the trigger mechanism can become unserviceable after being used only once, the controlled rectifier 120 employed in the arrangement according to FIG. 4 can be replaced by a simple diode 220, as shown in FIG. 5. This diode is switched in the blocking direction, permitting the charge from piezoelectric body 215 to flow to capacitor 263 of the ignition means via diode 262. However the electric strength of diode 220, employed as a switch, is dimensioned in such a manner that it is exceeded when capacitors 263 and 264 have almost completely received the charge supplied by piezoelectric body 215. This causes diode 220 to then break down. This diode is of a type which forms a short circuit in the event of a breakdown, thereby closing the path of current from capacitor 263 to ignition gap 265 of the ignition means, with the discharge current then flowing again igniting the ignition means.

The circuit illustrated in FIG. 5 is further intended for a trigger mechanism in which the striker rebounds from piezoelectric body 215 and the charge, with the opposite algebraic sign, resulting from the relief of the piezoelectric body flows through diode 261 to charging capacitor 264, whose voltage is added to the voltage of charging capacitor 263, which is charged in the above described manner. This is thus a voltage doubling circuit, which permits the electrical energy available for igniting the ignition means to be increased. A voltage doubling circuit of this or similar design can, of course, be employed irrespective of the nature of the switch employed.

The illustrated practical examples are characterized by their especially simple design as well as through their especially high degree of reliability. However it may also be practical to provide trigger mechanisms designed according to the invention in which the striker is already loaded with the striking force before the trigger is pulled and is merely released when the trigger is pulled.

Obviously, many modifications and variations of the present invention are possible in the light of the above teachings. It should therefore be understood that within the scope of the appended claims, the invention may be practiced otherwise than as specifically described.

Having thus fully disclosed our invention, what we claim is:

1. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, said striker being retained in the tensioned position by an engagement member, there being a striker spring arranged between trigger and striker, said striker spring being tensioned by pulling the trigger before the trigger engages said engagement member for releasing said striker.

2. The trigger mechanism set forth in claim 1, in which said trigger is designed as a slide and in which, in its direction of travel, said striker spring, said striker and said piezoelectric body are arranged one behind the other and said striker is in a supporting relationship with said trigger by means of said striker spring.

3. The trigger mechanism set forth in claim 2, in which said striker is guided in a tube, whose open end engages in a tubular extension of said trigger, with said piezoelectric body being arranged on its other end.

4. The trigger mechanism set forth in claim 3, in which a return spring for said trigger is arranged between the end of said tube and the base of said tubular extension.

5. The trigger mechanism set forth in claim 3, in which said striker has a head, facing said piezoelectric body, and a shank, on which said striker spring, designed as a coil compression spring, is arranged, with that end thereof facing away from said head engaging a hole, with a step-shaped configuration, in a portion of said trigger and having a collar which is in a supporting relationship with a shoulder of said step-shaped hole under the force of said striker spring when said trigger is not pulled.

6. The trigger mechanism set forth in claim 5, in which said portion of the trigger is formed by a sleeve inserted in said tubular extension, with said return spring also being in a supporting relationship therewith, in addition to said striker spring.

7. The trigger mechanism set forth in claim 6, in which, in the position of rest of said trigger, said striker is retained at a distance from said engagement member.

8. The trigger mechanism set forth in claim 3, in which said engagement member is form by a spring-loaded pawl arranged on the outside of said tube, the nose of said pawl penetrating into an aperture in the wall of said tube, with the free end of said pawl, facing said tubular extension of the trigger, having an inclined plane with which a corresponding inclined plane on said tubular extension engages when said trigger is pulled in order to deflect said engagement member.

9. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, said piezoelectric body being connected with a voltage doubling circuit comprising two capacitors connected both in series and individually parallel with said piezoelectric body via diodes in such a manner that, depending upon the polarity of the charge produced, either the one or the other of said capacitors is charged.

10. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, and in which said striker has a secondary striking mass.

11. The trigger mechanism set forth in claim 10, in which said secondary striking mass is formed by a granulate, in particular a tungsten granulate, arranged in a cavity in said striker.

12. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, said switch having mechanical switching means, in particular a contact tongue, with which said trigger comes into engagement after exceeding the position required for releasing said striking member.

13. The trigger mechanism set forth in claim 12, in which said mechanical switch is designed as a change-over switch, which short circuits those leads leading to the ignition means in its position of rest.

14. A trigger mechanism for electrically ignited wweapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, said switch being an electronic switch which closes upon attainment of a preselected voltage at the capacitor, siad electronic switch being a controllable rectifier, whose ignition electrode is connected to a preferably capacitative voltage divider connected in parallel with said capacitor.

15. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flowback from said capacitor to said piezoelectric body and the electrical energy stored in said capacitor is available for igniting said ignition means when said switch subsequently closes, said switch being an electronic switch which closes upon attainment of a preselected voltage at the capacitor, said electronic switch being a four-layer diode, which arcs through upon attainment of its forward breakover voltage.

16. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, said piezoelectric body being connected directly in parallel with a diode which, viewed in series with the diode connecting said piezoelectric body with said capacitor, has the same polarity as said diode.

17. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, said piezoelectric body being arranged together with a transmission body in an insulating housing, from which said transmission body extends on the side facing the striker.

18. A trigger mechanism for electrically ignited weapons having a source of electric energy and electrical ignition means, leads connecting the source of energy with the electrical ignition means for a propelling charge contained in the weapon, a trigger, and a normally open switch which is interposed in one of said leads and which can be closed for igniting said ignition means by pulling the trigger, in which said source of energy comprises a piezoelectric body and a capacitor connected in parallel with said piezoelectric body, in which said trigger is coupled with a striker which is tripped from a tensioned position when said trigger is pulled and released for striking said piezoelectric body before said switch closes, and in which said leads are connected with said capacitor and a diode is arranged between said piezoelectric body and said capacitor, the polarity thereof being such that the charge produced as a result of the blow of said striker against said piezoelectric body flows into said capacitor but cannot flow back from said capacitor to said piezoelectric body and the electrical energy stored in said capacitor is available for igniting said ignition means when said switch subsequently closes, the trigger mechanism further comprising a swivel member, which is retained by a spring in its position of rest and whose center of gravity is staggered perpendicular to the direction of travel of said trigger relative to the swivel axis of said swivel member, is arranged in the path of said trigger in such a manner that in the event of a blow acting in the sense of actuation of said trigger said swivel member performs a swivel motion against the force of said spring, thereby blocking said trigger.

19. The trigger mechanism set forth in claim 18, in which a grip is attached to the housing thereof, said grip being able to be swivelled into a position of rest, in which it covers said trigger and presses said swivel member out of the position of rest and into the locked position by means of a projection.

* * * * *